US005335839A

United States Patent [19]

Fealey

[11] Patent Number: 5,335,839

[45] Date of Patent: Aug. 9, 1994

[54] SPRING ACTUATED FASTENER DRIVING TOOL

[75] Inventor: William S. Fealey, Jamestown, R.I.

[73] Assignee: Stanley-Bostitch, Inc., East Greenwich, R.I.

[21] Appl. No.: 106,373

[22] Filed: Aug. 13, 1993

[51] Int. Cl.[5] ..... B25C 5/11

[52] U.S. Cl. ..... 227/132; 227/146

[58] Field of Search ..... 227/132, 128, 119, 120, 227/146

[56] References Cited

U.S. PATENT DOCUMENTS

| | | | |
|---|---|---|---|
| 348,236 | 8/1886 | Richards . | |
| 1,654,170 | 12/1927 | Hubbard . | |
| 2,326,540 | 8/1943 | Krantz | 227/132 X |
| 2,354,760 | 8/1944 | Lindstrom . | |
| 2,420,830 | 5/1947 | Maynard . | |
| 2,438,712 | 3/1948 | Lindstrom . | |
| 2,461,165 | 2/1949 | Lindstrom . | |
| 2,493,640 | 1/1950 | Peterson . | |
| 2,682,053 | 6/1954 | Ruskin et al. . | |
| 2,755,474 | 7/1956 | Spencer . | |
| 2,769,174 | 11/1956 | Libert | 227/132 |
| 2,795,787 | 6/1957 | Spencer . | |
| 2,996,720 | 8/1961 | Mackechnie . | |
| 3,172,122 | 3/1965 | Clay . | |
| 3,229,882 | 1/1966 | Abrams . | |
| 3,368,731 | 2/1968 | La Pointe . | |
| 4,126,260 | 11/1978 | Mickelsson . | |
| 4,184,620 | 1/1980 | Ewig | 227/132 X |
| 4,225,075 | 9/1980 | Chi | 227/132 X |
| 4,450,998 | 5/1984 | Ruskin . | |
| 4,452,388 | 6/1984 | Fealey | 227/132 |
| 4,483,066 | 11/1984 | Akira . | |
| 4,687,098 | 8/1987 | Ebihara . | |
| 4,984,729 | 1/1991 | Balma . | |
| 5,131,580 | 7/1992 | Allman | 227/132 |

*Primary Examiner*—Rinaldi I. Rada

*Attorney, Agent, or Firm*—Samuels, Gauthier & Stevens

[57] ABSTRACT

A spring actuated fastener driving tool has a lift pawl, bearings for supporting the lift pawl for pivotal movement about a first axis into and out of engagement with a power spring, and an operating handle continuously engageable with the bearings and intermittently engageable with the lift pawl. The operating handle is supported by a housing for pivotal movement about a second axis parallel to the first axis through successive driving cycles each including a loading phase during which the pawl remains engaged with the power spring as the power spring is resiliently deflected and loaded, and a release phase during which the pawl is disengaged from the power spring. The housing and the operating handle have guide surfaces which coact in sliding engagement with the bearings to accommodate movement of the bearings towards a reference plane containing the second axis during at least the loading phase of the drive cycles.

15 Claims, 7 Drawing Sheets

SPRING ACTUATED FASTENER DRIVING TOOL

BACKGROUND OF THE INVENTION

1. Field of the Invention

This invention relates to spring actuated fastener driving tools of the type employed to drive staples and the like into various work surfaces.

2. Description of the Prior Art

Spring actuated fastener driving tools are well known and widely employed in a variety of industrial and commercial applications. A typical example is disclosed in U.S. Pat. No. 4,452,388 issued on Jun. 5, 1984, the disclosure of which is herein incorporated by reference in its entirety. Although such conventional driving tools operate satisfactorily, there are certain attendant disadvantages to their methods of manufacture and assembly, as well as their repeated use over protracted periods of time. Of these, the relatively high level of force required to cycle such tools is of particular concern, since it can result in worker fatigue and loss of production efficiency.

Accordingly, a primary objective of the present invention is to achieve a beneficial reduction of the force required to cycle a spring actuated fastener driving tool, without any lessening of the driving force being generated by the tool.

A companion objective of the present invention is the provision of a smooth interaction of driving components, with minimum attendant shock and vibration as the tool is operated through successive driving cycles.

Still other objectives include an improvement in the feeding and separation of fasteners from the supply contained in the tool's magazine, as well as improvements in the manner in which the tool is manufactured and assembled.

SUMMARY OF THE INVENTION

In a fastener driving tool according to the present invention, lift pawls are pivotable about a first axis into and out of engagement with a power spring assembly responsible for generating the fastener driving force. The lift pawls are in turn connected to an operating handle which is pivotable about a parallel second axis through successive driving cycles, each including a loading phase during which the pawls remain engaged with the power spring assembly as the latter is resiliently deflected and loaded, and a release phase during which the pawls are disengaged from the power spring assembly, thereby allowing the power spring assembly to act through an associated driver to drive a fastener into or through a work surface. The first axis is defined by a bearing which is appropriately mounted and guided for movement towards the second axis during each loading phase, the result being a beneficial increase in mechanical advantage with an attendant lessening in the force required to operate the handle through successive drive cycles.

Other features, advantages and objectives will become more apparent as the description proceeds with the aid of the accompanying drawings, wherein:

DETAILED DESCRIPTION OF THE INVENTION

Figure 1:
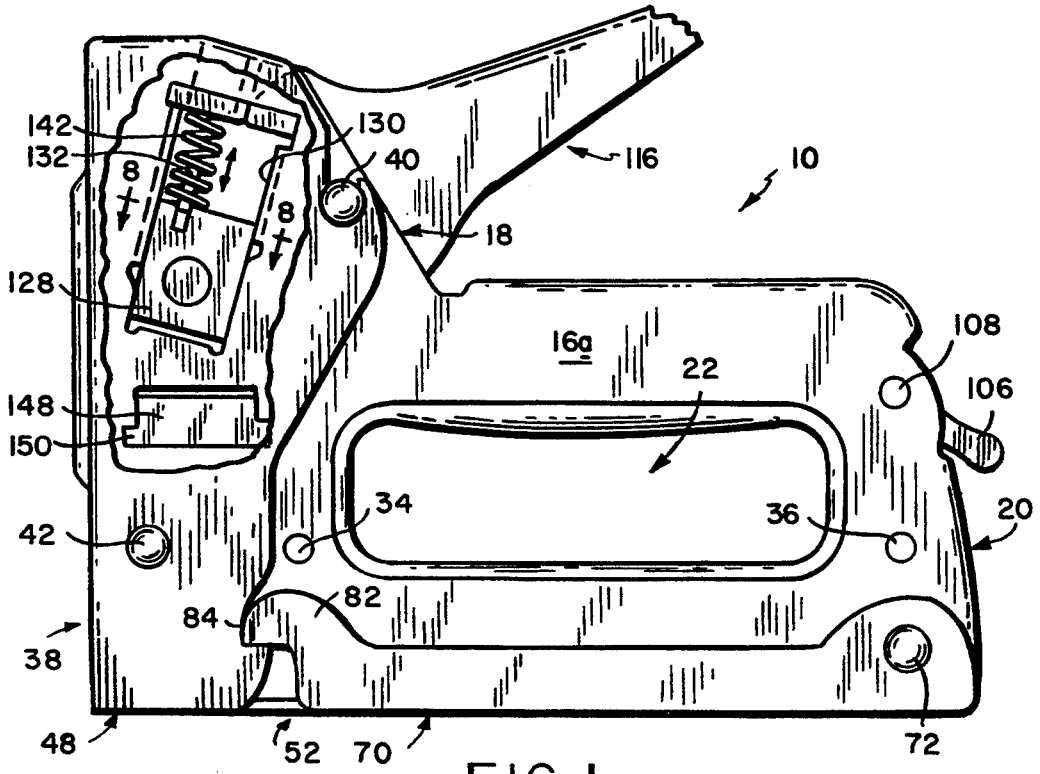
FIG. 1 is a view in side elevation of a fastener driving tool in accordance with the present invention, with portions of the outer housing broken away.

Referring now to the drawings, there is shown at 10 a spring actuated fastener driving tool according to the present invention. The tool is adapted to drive U-shaped staples 12 releasably interconnected in an elongated assembly indicated generally at 14 and typically referred to as a "stick". It will be understood, however, that the tool may be modified without departing from the spirit and scope of the invention to drive other types of fasteners, including for example brads, nails and the like.

The tool includes a basic housing comprising a mating pair of stamped sheet metal sides **16*a*, 16*b* appropriately shaped to define a head portion 18 and a base portion 20 with a finger opening 22 extending therethrough. An inner body 24 is positioned between the sides 16*a*, 16*b* in the base portion 20 of the housing. The inner body is preferably molded of a plastic material, typically DUPONT DELRIN 100 or the like. The inner body is provided at its forward end with a resilient cantilevered leg 26, and at its rearward end with a second resilient cantilevered leg 28 spaced inwardly from a rearwardly protruding boss 30. The boss 30 is straddled by the parallel legs 32*a* of a U-shaped spring bracket 32 having a depending tab 32*b* struck from its bight section 32*c***.

The sides **16*a*, 16*b* and the inner body 24 are interconnected by rivets 34, 36 or the like extending therethrough, with the rivet 36 additionally serving to join the spring bracket 32 to the boss 30 as part of this basic housing assembly. A nose cap 38 is fitted over the sides at the forward end of the housing. The nose cap is latched under the enlarged exposed heads of a handle pivot pin 40, and is secured in place by a third fastener, typically a pin 42 held in place by a conventional E-ring (not shown). The forward end of the inner body 24 cooperates with the sides 16*a*, 16*b* and the interior front surface 44 of the nose cap 38 to define a drive track 46 contained in a first reference plane $P_a$ and leading to an exit opening 48. A driver 50 is reciprocally mounted in the drive track 46. The forward leg 26 of the inner body serves to resiliently bias the driver 50 against the interior front surface 44 of the nose cap 38**.

Figure 13:
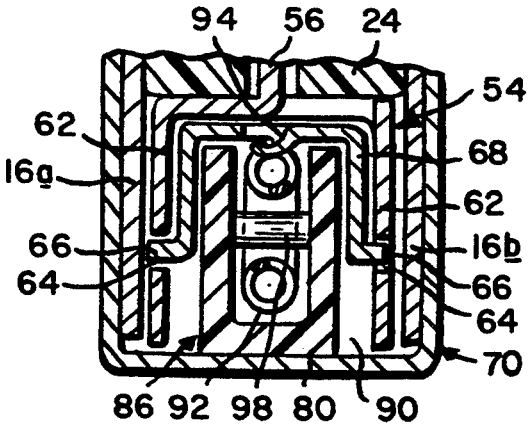
FIG. 13 is a sectional view taken along line 13—13 of FIG. 12.
Figure 12:
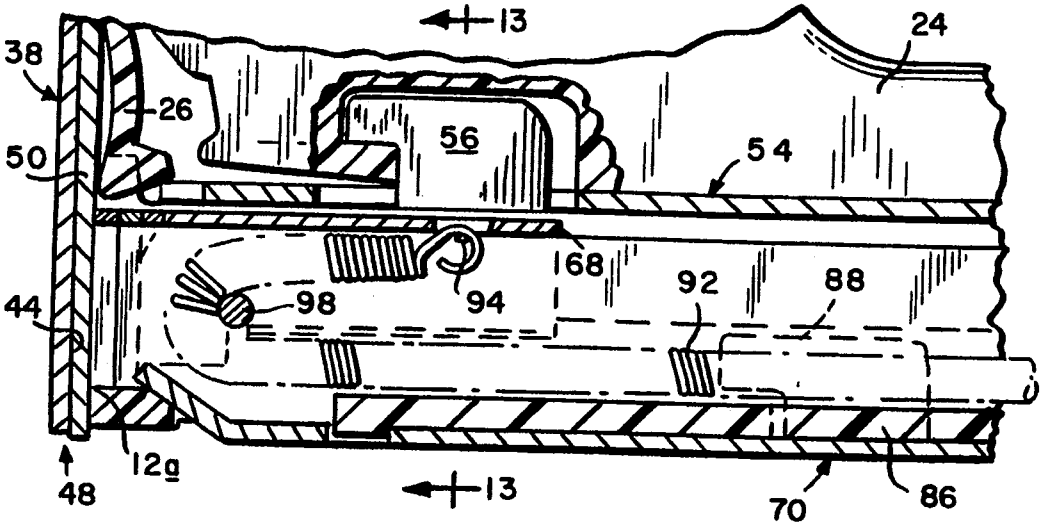
FIG. 12 is an enlarged foreshortened sectional view of the magazine in a closed condition.

A magazine assembly generally indicated at 52, is located along the underside of the tool. As can best be seen by reference to FIGS. 12–14, the magazine assembly includes an inverted generally channel shaped magazine shell 54 having an L-shaped 56 finger at its forward end received in a complimentary slot in the underside of the inner body 24. The rear end of the magazine shell has an aperture 58 in its bight section spaced inwardly from a rearwardly extending horizontal flange 60. The resilient rear leg 28 of the inner body 24 snaps into the aperture 58 and serves to resiliently bias the magazine shell 54 forwardly into contact with the interior front surface 44 of the nose cap 38.

Figure 14:
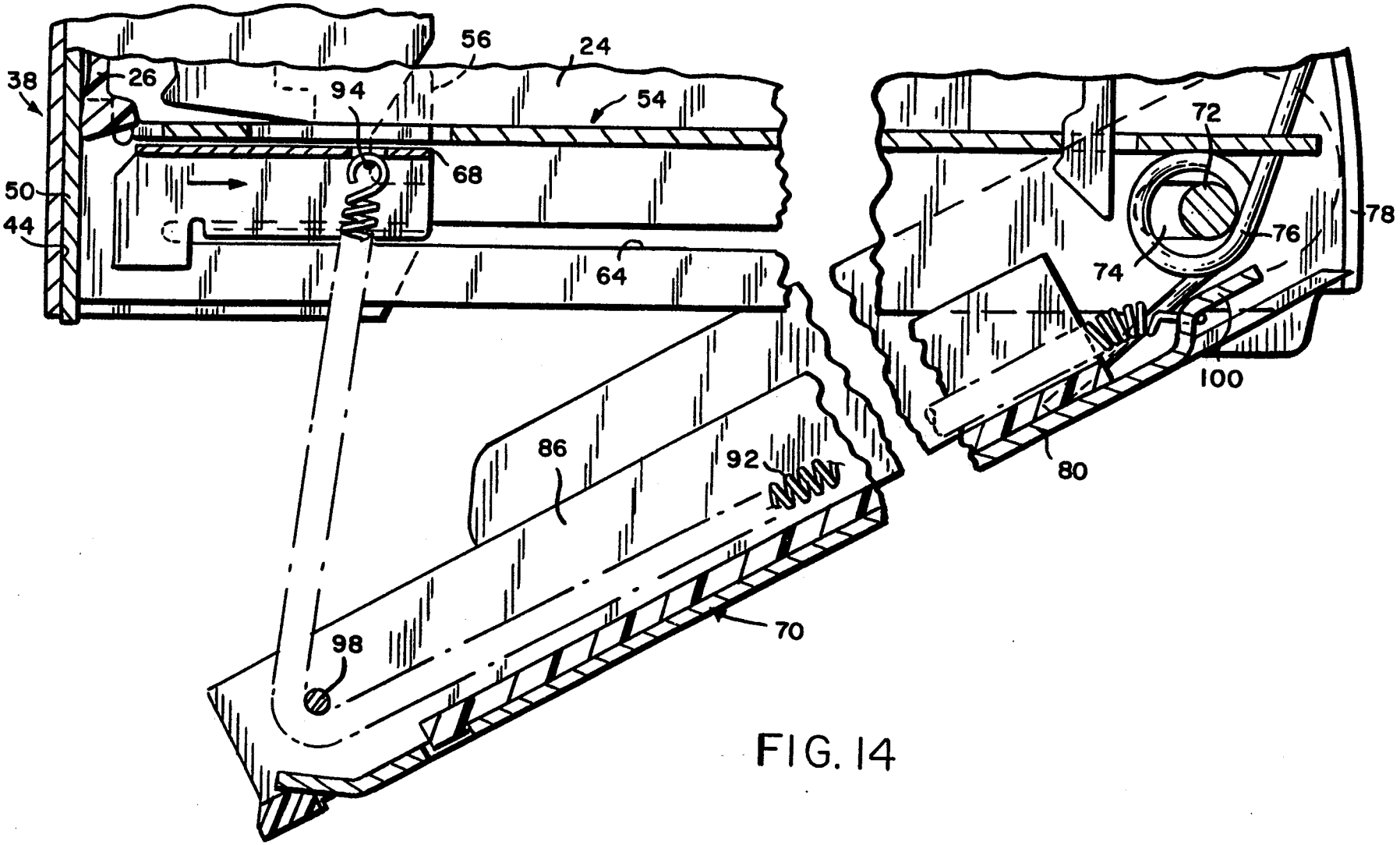
FIG. 14 is a view similar to FIG. 12 showing the magazine in a partially opened condition.

The depending side walls 62 of the magazine shell are slotted as at 64 to receive the laterally protruding ears 66 of a channel shaped pusher 68 designed to slide longitudinally within the magazine shell. A channel-shaped metal shoe 70 is pivotally connected to the lower rear end of the housing by a pin 72 extending through elongated openings 74 in the sides **16*a*, 16*b*. A shoe spring 76 encircles the pin 72 and has angularly extending legs coacting resiliently with a rear housing wall 78 and the bight section 80 of the shoe. The forward end of the shoe 70 has a nose 82 (see FIG. 1) in latched engagement as at 84 with shoulders on the nose cap 38. The shoe spring 76 coacts with the rear housing wall 78 and the pin 72 to resiliently hold the shoe in closed latched engagement with the nose cap. In order to gain access to the magazine interior, the shoe 70 is pushed rearwardly against the biasing action of the shoe spring 76, thereby unlatching the nose 82 as the pin 72 is pushed rearwardly in elongated openings 74. The shoe is then swung open about pin 72 as shown in FIG. 14**.

A core 86 is carried on the shoe 70. The shoe 70 has L-shaped fingers 88 struck from its bight section which coact with complimentary recesses in the core to hold the core in place. The magazine shell 54 and the core 86 cooperate, when the shoe is in its closed latched position, to define a guide channel 90 for the staple stick 14 and for the pusher 68.

A pusher spring 92 is connected at one end to a tab 94 struck from the bight section of the pusher 68. Spring 92 extends forwardly around a cross pin 98 at the forward end of the core 86 and then rearwardly for connection at its opposite end to a tab 100 struck from the bight section of the shoe 70.

The pusher spring 92 biases the pusher 68 forwardly, thereby urging a stick 14 of staples or the like in the same direction. The end most staple **12*a* is urged against the back side of the driver 50 when the driver is located in the position shown, for example, in FIGS. 2 and 12**.

Figure 2:
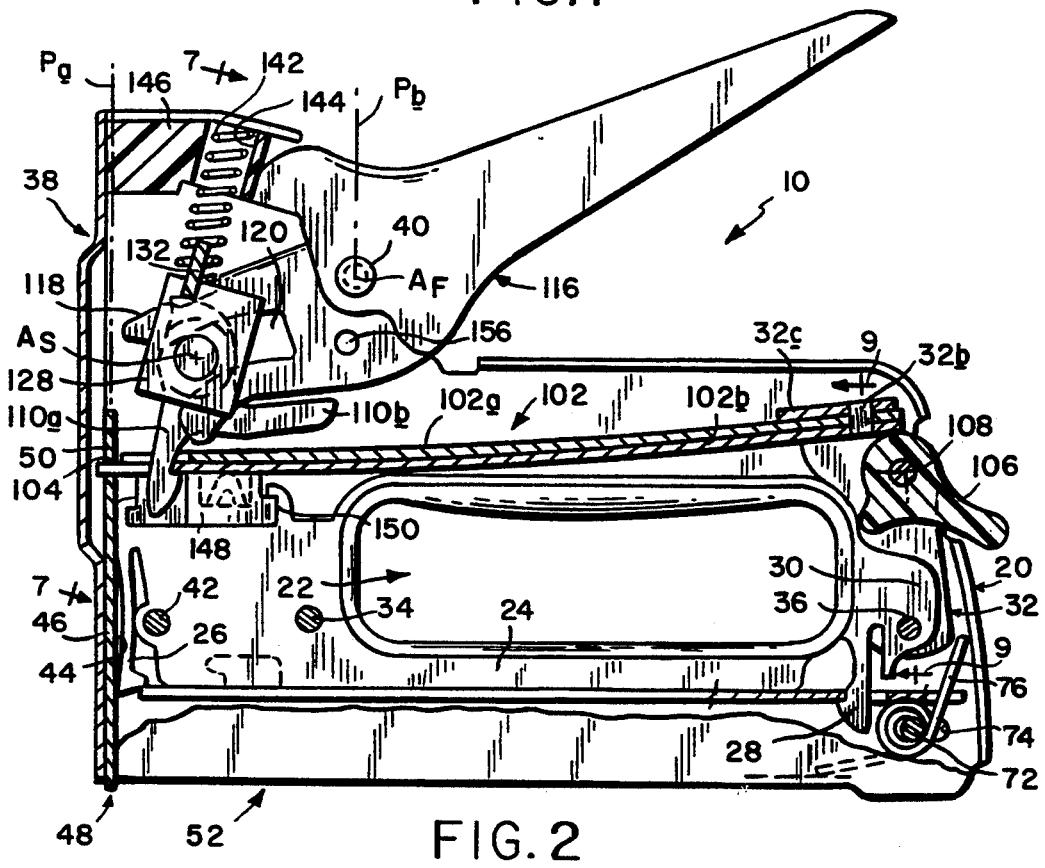
FIG. 2 is a vertical sectional view of the tool shown in FIG. 1.
Figure 9:
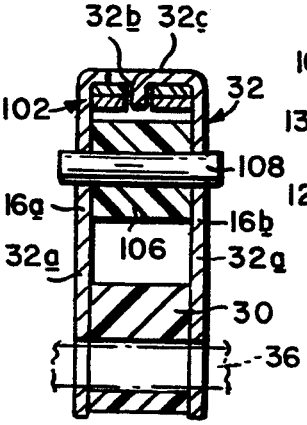
FIG. 9 is a sectional view taken along line 9—9 of FIG. 2.

With reference to FIGS. 2 and 9, a power spring assembly generally indicated at 102 is located in the upper area of the housing base portion 20. Spring assembly 102 includes upper and lower superimposed leaf springs **102*a*, 102*b*. Lower leaf spring 102*b* has a nose at its forward end protruding into interlocked engagement in an opening 104 in the upper end of driver 50**.

The rear end of the spring assembly 102 extends beneath the bight section **32*c* of the spring bracket 32, and the lower leaf spring 102*b* rests on an adjustment lever 106 pivotally supported between the legs 32*a* of the spring bracket by a pin 108. The tab 32*b* struck from the bight section of the spring bracket extends downwardly into aligned apertures in the springs, thereby serving to locate the springs longitudinally within the housing. The adjustment lever 106** has an eccentric portion which can be rotated in a known manner to vary spring driving power.

Figure 7:
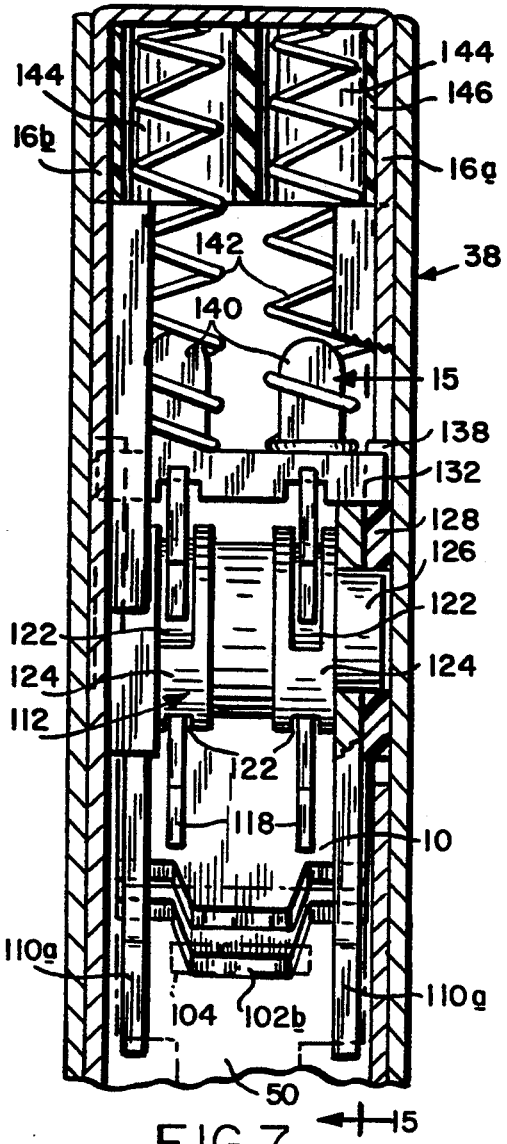
FIG. 7 is an enlarged sectional view taken along line 7—7 of FIG. 2.
Figure 11:
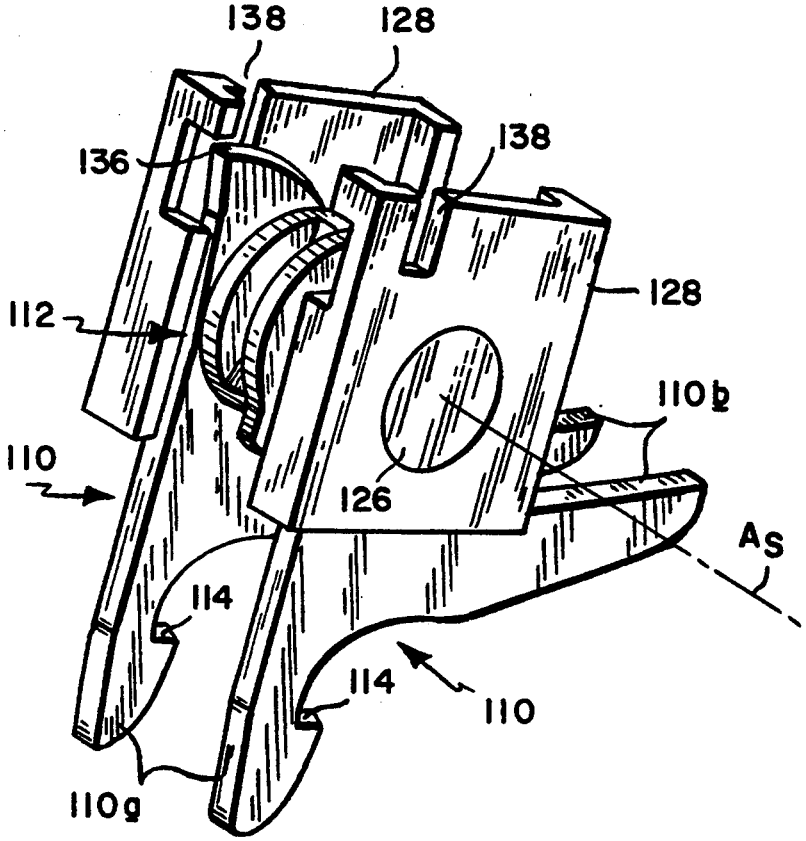
FIG. 11 is a perspective view of a subassembly of the lift bearing, lift pawls and slide plates shown removed from the housing.

As can best be seen by reference to FIGS. 2, 7 and 11, a pair of pawls 110 are carried on a lift bearing 112 for pivotal movement about a shiftable axis of rotation $A_S$. The pawls have extensions **110*a*, 110*b* extending respectively downwardly and rearwardly with respect to axis $A_S$. The downward extensions 110*a* have shoulders 114 adapted to coact in latched engagement with the lower leaf spring 102*b***.

A handle assembly 116 is mounted for pivotal movement about a fixed axis of rotation $A_f$ defined by the handle pin 40 extending between the side **16*a*, 16*b*. As depicted in FIG. 2, axis $A_f$ is contained in a second reference plane $P_b$ parallel to reference plane $P_A$. The handle assembly 116 includes an interiorly protruding bifurcated portion with spaced walls 118 interrupted by arcuate slots 120**.

Figure 8:
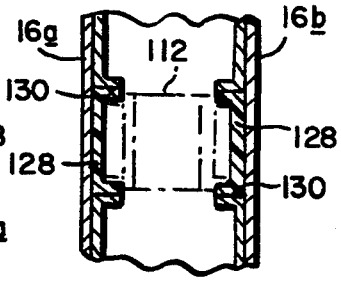
FIG. 8 is a sectional view taken along line 8—8 of FIG. 1, with the lift bearing depicted in broken lines.

The upper and lower arcuate edges of the slots 120 are received respectively in upper and lower arcuate grooves 122 in enlarged diameter portions 124 of the lift bearing 112. The reduced diameter ends 126 of the lift bearing are journalled for rotation about axis $A_s$ in slide members 128. As can be best be appreciated by reference to FIGS. 1 and 8, the slide members 128 are in turn arranged to move reciprocally indicated schematically at "x" in FIG. 1 within angularly disposed windows 130 in the housing sides **16*a*, 16*b***.

Figure 15:
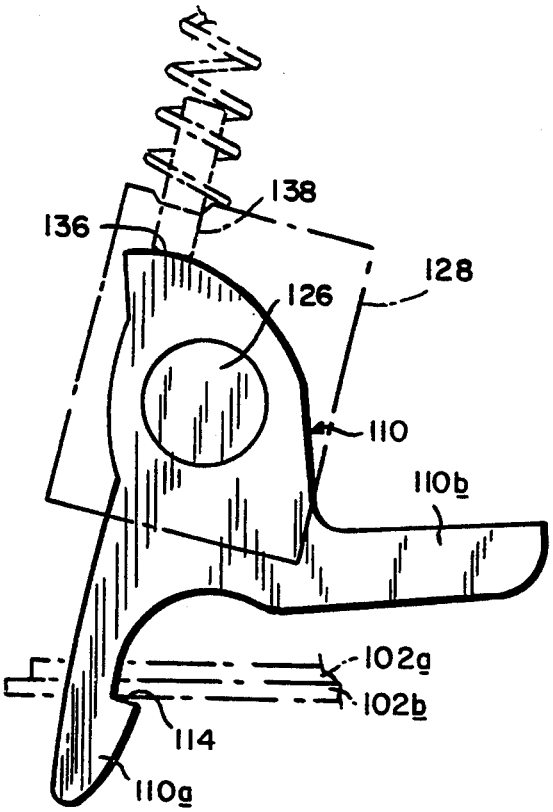
FIG. 15 is a sectional view taken along line 15—15 of FIG. 7.
Figure 10:
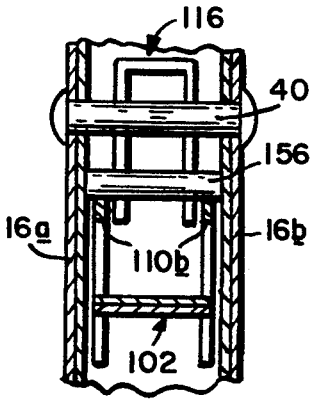
FIG. 10 is a sectional view taken along line 10—10 of FIG. 4.

With reference to FIGS. 7 and 15, a spring anchor 132 extends between and has a bottom edge resting on offset radial surfaces 136 of the lift pawls. The spring anchor has ends received in notches 138 in the slide members 128, and upwardly protruding fingers 140 received in the lower ends of return springs 142. The upper ends of the springs 142 in turn are received in bores 144 extending through a handle stop 146 located in the head portion of the housing.

The return springs 142 bias the pawls 110 into counterclockwise rotation (as viewed for example in FIG. 2) about axis $A_s$, thereby insuring that the downward pawl extensions **110*a* are resiliently urged into latched engagement with the lower leaf spring 102*b*. In the rest position shown in FIG. 2, the forward end of the spring assembly 102 is supported on a bumper 148 located in a pocket 150 at the forward end of the inner body 24**.

Figure 4:
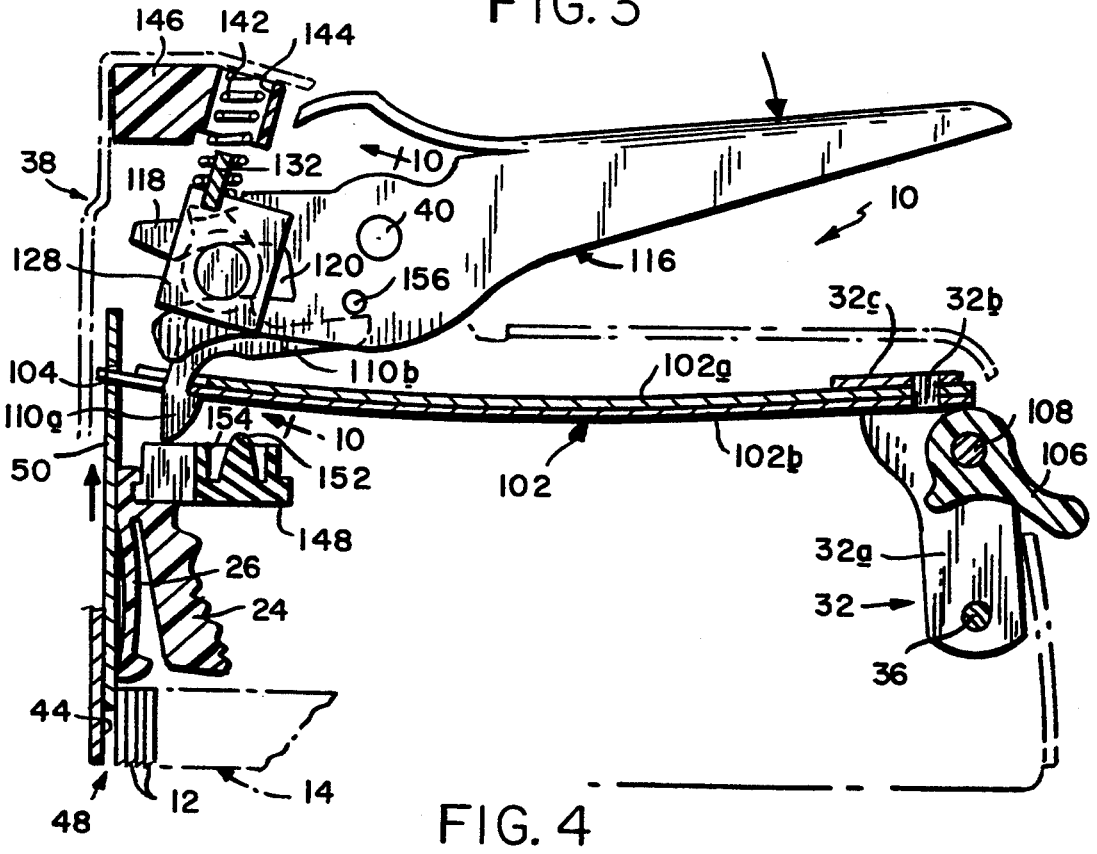

The bumper 148 is integrally molded of a resilient material, e.g., urethane, and has a vibration damping element in the form of a hollow inverted cone 152 spaced inwardly from and surrounded by a peripheral wall 154. In its unstressed state, as depicted in FIG. 4, the cone 152 extends upwardly above the top edge of the peripheral wall 154.

Figure 3:
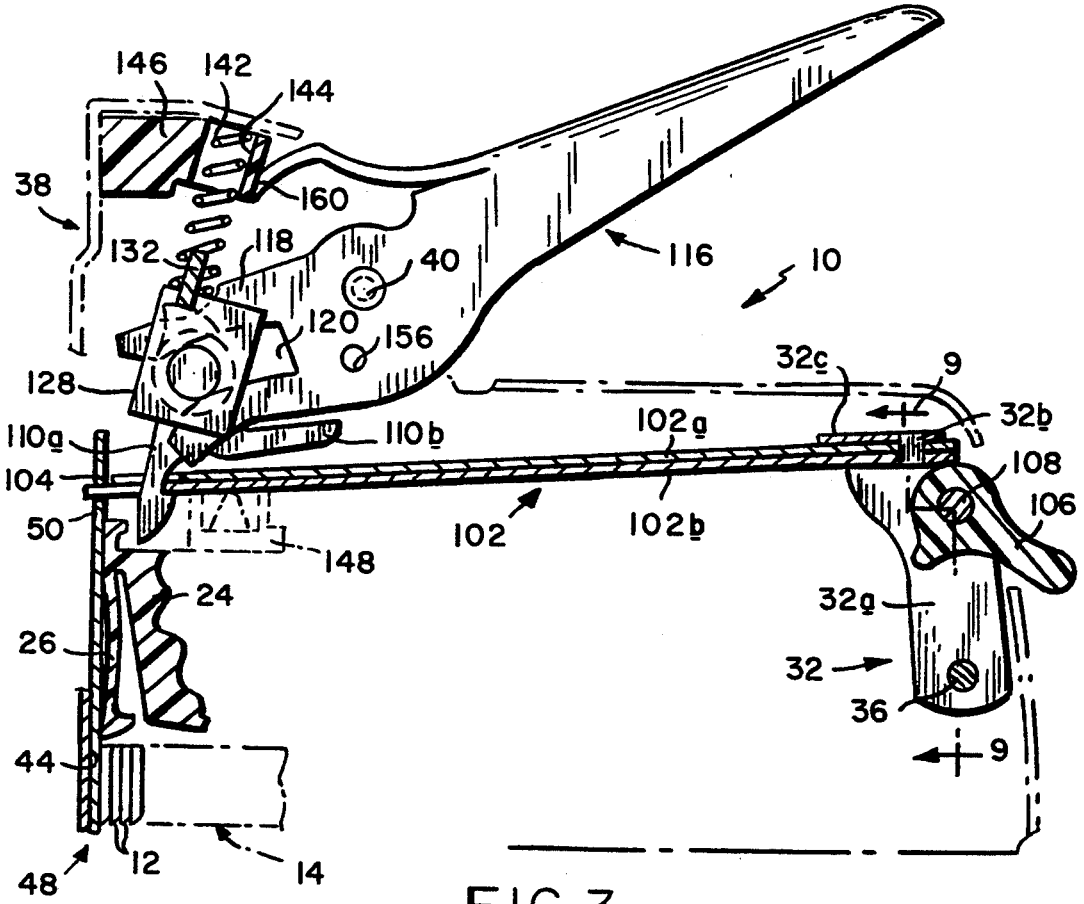
FIGS. 3–6 are partial vertical sectional views similar to FIG. 2 showing the tool during various phases of a fastener driving cycle.

When the handle assembly 116 is in a rest position as illustrated in FIGS. 1–3, the power spring assembly 102 is supported on the bumper 148, the driver 50 is at its extreme bottom position extending across the forward end of the magazine shell 54 and the pusher spring 92 is acting through the pusher 68 to urge an assembly or "stick" 14 of staples forwardly, thereby pressing the end most staple **12*a* of the stick against the back side of the driver 50**.

Figure 5:
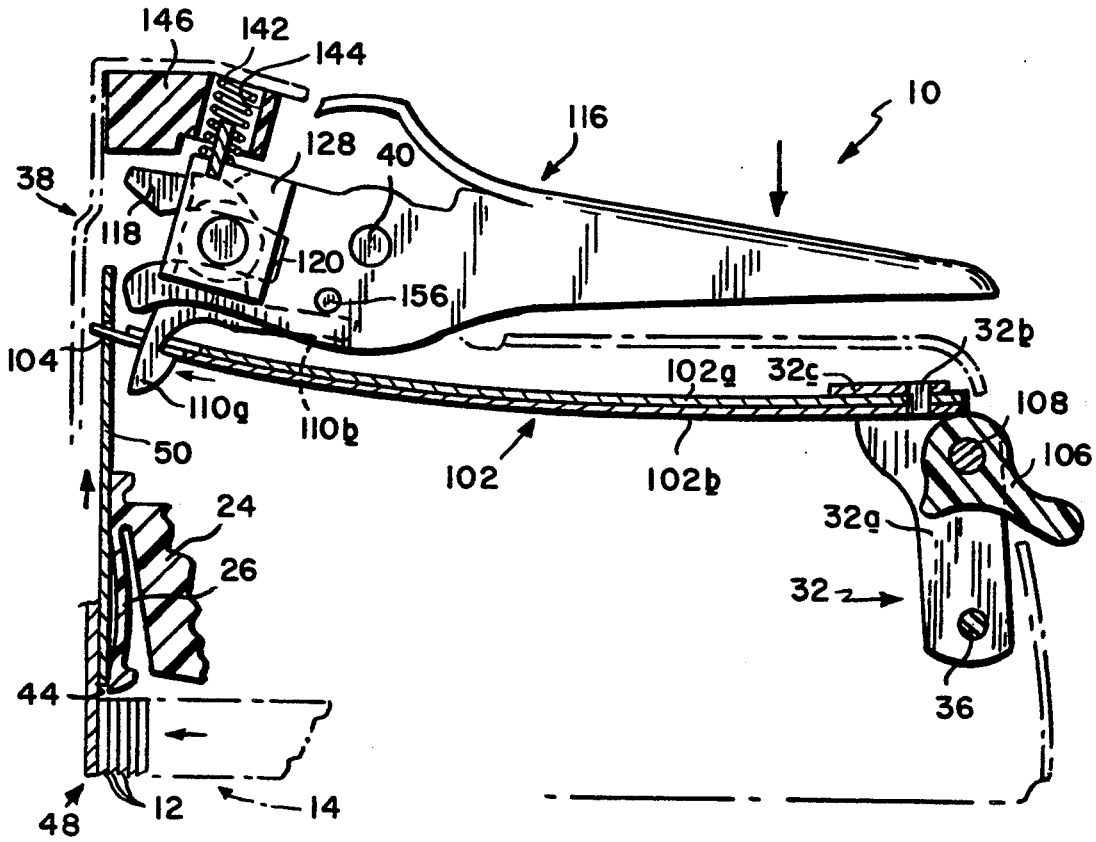

In FIG. 5, the handle assembly has been pivoted in a clockwise direction to an intermediate position at which it has acted through the lift bearing 112 and the pawls 110 to resiliently deflect and load the power spring assembly 102, with an accompanying retraction of the driver 50 from the forward end of the magazine. This clears the way for the end most staple 12*a* to advance into the drive track 46 where it continues to be held by the biasing action of the pusher 68 and pusher spring 92 against the interior front surface 44 of the nose cap 38. The driver 50 is resiliently biased against the same interior front surface by the resilient leg 26 of the inner body 24, thereby insuring alignment of the driver 50 with staple 12*a*.

As the handle assembly 116 is being depressed to deflect and gradually increase the loading of spring assembly 102, the lift bearing 112 gradually moves along the inclined path "x" defined by the guiding action of the inclined housing windows 130 on slide members 128. At the same time, the lift bearing is moving deeper into the arcuate slots 120 of the handle side walls 118. The net result is a gradual decrease in the spacing between axis $A_s$ and $A_f$ as the lift bearing moves away from reference plane $P_a$ and towards reference plane $P_b$, with an accompanying increase in the mechanical advantage afforded by handle leverage.

Figure 16:
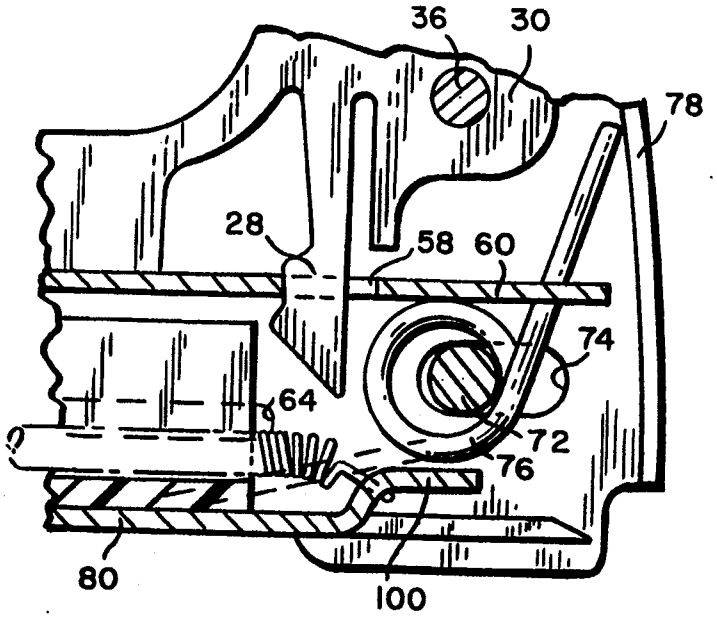
FIG. 16 is a force diagram.
Figure 16:
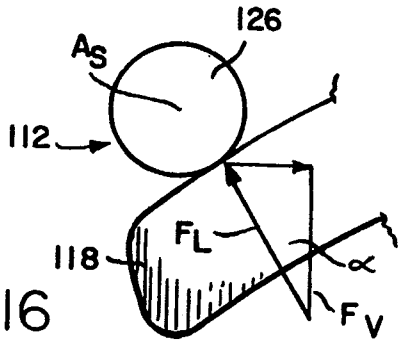

With reference to FIG. 16, it will be additionally understood that the angle $\alpha$ defined between the lift force $F_L$ being exerted on the lift bearing 112 and the vertical component $F_v$ of that force gradually diminishes, with an accompanying increase in $F_v$ since it is a function of the cosine $\alpha$. At this juncture, the rearward extensions 110*b* of the pawls are brought onto initial contact with a pawl pin 156 on the handle assembly.

The net result of these relationships is greater motion at reduced mechanical advantage in the early stages of the stroke, when power spring resistance is at its minimum, followed by increased mechanical advantage and greater lifting force as spring resistance increases during the latter part of the stroke. Comparisons of this arrangement with conventional arrangements of the type disclosed in U.S. Pat. No. 4,452,388 show a reduction of approximately 35% in the handle pressure required to generate the same driving force.

Figure 6:
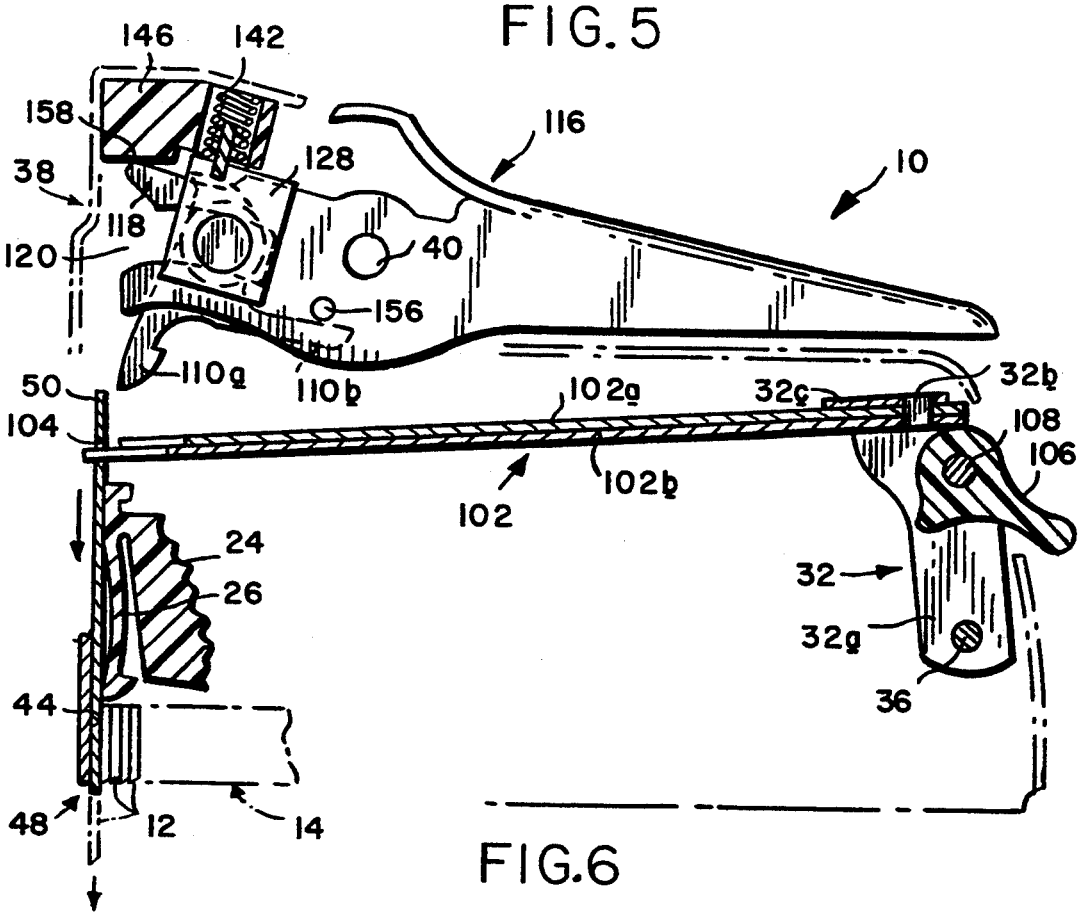

Referring now to FIG. 5, continued clockwise rotation of handle assembly 116 with the rearward pawl extensions 110*b* in contact with the pawl pin 156 causes the lower extensions 110*a* of the pawls to disengage from the spring assembly 102. When this occurs, and as shown in FIG. 6, the spring assembly unloads and fires the driver 50 downwardly, thereby forcing the end most staple 12*a* outwardly through exit opening 48 and into a work surface (not shown). Further clockwise motion of the handle assembly is arrested by contact as at 158 with the handle stop 146.

It will be understood that as the handle assembly 116 is being rotated in a clockwise direction to effect loading and then release of the power spring assembly 102, the return springs 142 are being compressed between the spring anchor 132 and the inturned edges of the sides 16*a*, 16*b* which define the bottoms of the bores 144 in the handle stop 146. When pressure on the handle assembly is released, the return springs gradually unload, thereby serving to return the handle assembly to the rest position shown in FIGS. 1 and 2 while at the same time urging the pawls 110 to rotate in a counterclockwise direction about axis $A_s$ as the lift bearing moves towards the front of arcuate slots 120 and the slide members 128 move downwardly at an angle in windows 130. The pawls thus reengage with the power spring assembly in preparation for the next drive cycle, and the handle assembly again comes to rest against the handle stop 146 at 160.

In light of the foregoing, it will now be appreciated by those skilled in the art that the present invention offers a number of significant advantages over conventional spring actuated fastener driving tools. Most significantly is the interaction of the handle assembly 116, lift bearing 112 and pawls 110 in conjunction with movement of the slide members 128 in the housing windows 130 to provide greater motion at reduced mechanical advantage in the early stages of the stroke when power spring resistance is at its minimum, followed by an exertion of maximum force at reduced handle pressure as the power spring assembly reaches its fully loaded position.

Also of significance is the provision of the spring bracket 32 which holds and positions the leaf springs 102*a*, 102*b* of the power spring assembly 102, and in doing so receives the highest internal loads developed during the spring stressing stroke. This arrangement allows the main housing components 16*a*, 16*b* to be used without first being heat treated, thereby facilitating manufacturing and simplifying assembly by avoiding distortion and subsequent necessary adjustments.

The engagement of the downwardly bent tab 32*b* of the spring bracket in the aligned apertures of the power leaf springs 102*a*, 102*b* provides accurate horizontal positioning of the front edge of the lower spring 102*b* where it is engaged by the lift pawls. The spring bracket 32 and its associated adjustment lever 106 also provide a convenient means for varying the driving power being generated by the power spring assembly 102.

The inner body 24 is sandwiched between the two housing sides 16*a*, 16*b* together with the spring bracket 32. These components are rivetted together as a single assembly which becomes the unit onto which all other components are assembled. The rivetting operation is the only permanent fastening performed, and is designed to be part of a "final" assembly procedure, so that no interim subassemblies are created. This approach significantly aids in ease of manufacture and assembly by avoiding the traditional welding and rivetting of subassemblies.

The biasing action of the resilient cantilevered front leg 26 of the inner body on the driver 50 insures that the driver is always properly aligned with the lead staple advanced into the drive track 46. This provides maximum clearance for the next adjacent staple in the stick and thereby insures a clean separation of the lead staple during the driving stroke. This biasing action also serves to dampen driver vibration as the power spring assembly 102 comes to rest on the bumper 148. The vibration dampening cone 152 on the bumper further serves to avoid annoying and potentially damaging power spring vibration.

The cantilevered resilient rear leg 28 of the inner body serves two purposes. First, it facilitates assembly by allowing the finger 56 at the forward end of the magazine shell to be hooked into the complimentary recess in the inner body and then allowing the opening 58 at the rear end of the magazine shelf to be snapped onto the leg 28. Secondly, when the nose cap 38 is assembled onto the housing, the magazine shell will be pushed slightly against the resilient bias of leg 28 so as to produce a firm contact between the interior front surface 44 of the nose cap and the front edges of the magazine shell.

Thereafter, when the shoe and its core are pivotally connected to the housing by means of the pin 72 and shoe spring 76, these components will underlie the rear tab 60 of the magazine shell, thereby preventing any possibility of the magazine shell becoming accidentally disengaged from the inner body.

The attachment of the core to the shoe by means of the finger/recess engagement avoids welding and also accommodates the possibility of interchanging different sized cores in order to accommodate various fastener sizes.

The manner of attaching the magazine shell to the inner body and the core to the shoe allows both the magazine and core to "float" so that each component may align itself with the other, and with the staples, thereby minimizing feeding problems that might otherwise arise if these components were fixed in relation to each other.

The handle stop conveniently serves a dual function of a return spring housing, and is engageable by the handle assembly at both extremes of its pivotal motion.

I claim:

1. A spring actuated fastener driving tool, comprising:

a housing including a magazine for containing an elongated assembly of releasably interconnected fasteners, said magazine having a forward end and a drive track extending past said forward end to an exit opening;

biasing means associated with said magazine for urging an assembly of fasteners contained therein towards said forward end;

a drive element mounted for reciprocal movement along said drive track;

elongated power spring means for reciprocating said drive element, said power spring means being anchored at one end with respect to said housing and being connected at an opposite end to said driver element;

bearing means for establishing a first axis of rotation, said bearing means being carried by said housing;

pawl means for releasably connecting said bearing means to said power spring means, said pawl means being carried by said bearing means for pivotal movement about said first axis into and out of engagement with said power spring means;

return spring means associated with said housing for biasing said pawl means into engagement with said power spring means;

a handle engageable with said bearing means and mounted on said housing for pivotal movement about a second axis of rotation parallel to said first axis, said first axis being located between first and second parallel reference planes respectively containing said drive track and said second axis, said handle being pivotable about said second axis through successive driving cycles each including:

a) a rest position at which said driver element extends across the forward end of said magazine to provide an abutment against which an endmost fastener of said assembly is urged by said biasing means;

b) an intermediate position acting through said bearing means and said pawl means in engagement with said power spring means to resiliently deflect and load said power spring means with an accompanying retraction of said driver element from the forward end of said magazine to thereby permit said endmost fastener to advance into said drive track; and c) a release position at which said pawl means is disengaged from said power spring means and said power spring means is thus freed to resiliently return said driver element to its location at said rest position, thereby ejecting a fastener in said drive track from said housing through said exit opening; and guide means associated with said housing for accommodating displacement of said bearing means towards said second reference plane in response to pivotal movement of said handle from said rest position to said release position.

2. The fastener driving tool of claim 1 wherein said guide means includes an arcuate track on said handle.

3. The fastener driving tool of claim 2 wherein said bearing means progresses along said arcuate track in response to pivotal movement of said handle about said second axis.

4. The fastener driving tool of claim 1 further comprising stop means on said handle, said pawl means being rotatable relative to said handle during movement of said handle from said rest position through said intermediate position, and being engageable with said stop means to effect disengagement of said pawl means from said power spring means at said release position.

5. The fastener driving tool of claim 4 wherein said pawl means includes angularly disposed first and second extensions, said first extensions being releasably engageable with said first spring means, and said second extensions being engageable with said stop means.

6. The fastener driving tool of claim 1 wherein said pawl means includes latch segments engageable with coacting segments of said power spring means, said latch segments and said coacting spring segments being movable simultaneously about said second axis along coincident arcuate paths to effect resilient deflection and loading of said power spring means, and being movable simultaneously about said second axis along diverging arcuate paths to effect disengagement of said latch segments from said coacting spring segments.

7. The fastener driving tool of claim 1 wherein said housing includes mating side components, and wherein said bearing means is carried on slide members movably supported by said side components.

8. The fastener driving tool of claim 7 wherein said slide members are supported by said side components for movement along a path extending angularly between said first and second parallel reference planes.

9. The fastener driving tool of claim 8 wherein said return spring means exerts a biasing action on said slide members.

10. The fastener driving tool of claim 1 wherein said housing includes mating side components defining a hollow interior which is subdivided by said power spring means into first and second compartments, said magazine being arranged in said first compartment at a location spaced from said power spring means by an inner body component secured between said side components, said bearing means, pawl means, return spring means, handle and guide means being arranged in said second compartment.

11. The fastener driving tool of claim 10 wherein said inner body component is molded of a plastic material, with resilient cantilevered first and second legs located respectively at opposite ends thereof.

12. The fastener driving tool of claim 11 wherein said drive track is defined in part by a nose cap forming a front wall of said housing, and wherein said cantilevered first leg exerts a biasing force urging said drive element against said front wall.

13. The fastener driving tool of claim 10 further comprising a bumper element supported by said inner body component at a location engageable by said power spring means when said driver element is returned to its location at said rest position, said bumper element being resilient, non metallic and having a vibration dampening element spaced inwardly from and surrounded by a peripheral wall having an upper edge, said dampening element protruding above said upper edge for initial contact by said first spring means.

14. The fastener driving tool of claim 13 wherein said dampening element comprises an inverted cone formed integrally with said peripheral wall.

15. In a spring actuated fastener driving tool having a lift pawl pivotally movable about a first axis into and out of engagement with a power spring, the lift pawl being movably responsive to pivotal movement of an operating handle supported by a housing for pivotal movement about a second axis parallel to the first axis through successive driving cycles each including a loading phase during which the pawl remains engaged with the power spring as the power spring is resiliently deflected and loaded, and a release phase during which the pawl is disengaged from the power spring, the improvement comprising: bearing means for supporting said pawl for pivotal movement about said first axis, and means movable in relation to said housing for supporting said bearing means for movement towards a reference plane containing said second axis during at least the loading phase of said drive cycles.

* * * * *